United States Patent [19]

Perry

[11] 4,416,589

[45] Nov. 22, 1983

[54] VIBRATION ACTUATED LIQUID PUMP

[76] Inventor: John C. Perry, 3170 Falcon Dr., Carlsbad, Calif. 92008

[21] Appl. No.: 303,216

[22] Filed: Sep. 18, 1981

[51] Int. Cl.[3] ..... F04B 17/00; F04B 35/00; F04B 21/04

[52] U.S. Cl. ..... 417/211; 417/550

[58] Field of Search ..... 417/240, 241, 211

[56] References Cited

U.S. PATENT DOCUMENTS

| | | | |
|---|---|---|---|
| 1,840,759 | 1/1932 | Wheeler | 417/211 |
| 3,077,162 | 2/1963 | Banerian | 417/460 |
| 3,091,954 | 6/1963 | Bullock et al. | 417/550 |
| 3,116,695 | 1/1964 | Faller | 417/241 |
| 3,190,266 | 6/1965 | Malec | 417/550 |

*Primary Examiner*—William L. Freeh

*Attorney, Agent, or Firm*—Robert G. Upton

[57] ABSTRACT

A positive displacement liquid pump having a free-moving weight mass spaced from and oscillatably positioned concentrically within a cylindrical housing is disclosed. A pair of cooperating one-way valves, one valve communicating with a central passage defined by the weight mass while the other valve communicates with an inlet to the housing, coact to draw in fluid or liquid from a supply source. As the oscillatable weight mass moves away from the inlet, the one-way inlet valve opens, filling a chamber behind the weight mass. The one-way valve in the weight mass simultaneously closes enabling the weight mass to drive fluid out of the reservoir chamber at an exit end of the housing, the valves acting oppositely when the weight mass oscillates back toward the housing inlet. The free-moving weight mass suspended within the pump housing is set in motion by the oscillatory motion of a vibration source without direct mechanical actuation of the device from a power source. The movement of the oscillating weight mass may be amplified by the addition of a coil spring or a resilient rubber "bumper" at one or both ends of the piston weight mass.

5 Claims, 5 Drawing Figures

VIBRATION ACTUATED LIQUID PUMP

CROSS-REFERENCE TO RELATED APPLICATION

This application is related to a co-pending patent application, entitled Vibration Actuated Liquid Pump, Ser. No. 252,383, assigned to the same assignee as the present invention.

BACKGROUND OF THE INVENTION

1. Field of the Invention

This invention relates to positive displacement fluid pumps.

More particularly, this invention relates to a positive displacement liquid pump with integral fuel regulating means which is actuated solely by a source of vibration. The pump housing is so mounted to be within vibratory range of a source of vibration.

2. Description of the Prior Art

There are many positive displacement pumps within the state of the art, all of which are actuated either mechanically or through a directly connected source of pulsating pressure.

All of these prior art devices are disadvantaged in that the pumps must be either mechanically or directly connected through a hose or conduit means to a pump-driving source, whether it be a reciprocating engine or an electric motor. Either way, the pump drains off power and energy from its driving source.

The present invention requires no physical attachment whatsoever either through mechanically actuatable rods or hose connections to actuate the pump. Hence there is positively no power drain or loss of efficiency to associated equipment. The invention is actuated by the oscillatory action of a source of vibration which drives a free-stroking weight or mass within a cylinder back and forth, thereby actuating a pair of coacting one-way valves to draw in and expel liquid through the pump. The sole actuating means is a source of vibration, the pump being axially aligned with the propogating direction of the oscillatory motion set up by the source of vibration. For example, an operating two-cycle engine secured to an engine mount vibrates and sets up oscillating motion through the torque generated by the engine. The pump then, when mounted to the firewall of the engine, is subject to oscillatory, vibrational motion. The vibration alone is sufficient to drive the weight mass within the pump axially back and forth, thus supplying, for example, fuel to a carburetor of an engine.

An example of the state of the art technology readily available in the Patent and Trademark Office is U.S. Pat. No. 2,572,977. This invention describes a piston within a housing with an inlet valve on one end of the housing, a valve in the hollow piston and a third valve at the exit end of the housing. The valve in the inlet end of the housing cooperates with the valve in the piston. As the piston moves away from the inlet end of the housing, fluid is drawn into the inlet end and, as the piston moves toward the inlet end, fluid is driven through the one-way valve within the piston to fill a chamber on the exit end of the piston. As the piston oscillates toward the exit end of the housing, fluid is driven out of the third valve which allows fluid to escape through the valve and out of the pumping device. This invention is disadvantaged in that it is directly connected to an oscillatory power source which mechanically links the pumping device to the power source and the power source is a sole motivational means for oscillating the piston mass within the housing.

U.S. Pat. No. 3,077,162 describes a piston which is frictionally engaged with a cylinder wall and, as the piston oscillates between the inlet and exit end of a housing, a pair of coacting valves pass fluid through the pump. The invention is disadvantaged in that there is wear and friction involved between the piston and the cylinder wall of the housing of the state of the art pump. The positive displacement pumps described in both of the foregoing patents will eventually become inefficient as the pistons wear.

SUMMARY OF THE INVENTION

It is an object of this invention to provide a positive displacement fluid pump driven solely by vibrational means, the piston weight mass being suspended between a pair of resilient rings without contact of the weight mass with the body of the pump as the weight mass oscillates within the pump housing.

It is another object of this invention to provide a positive displacement liquid pump with integral pump regulating means that is driven solely by oscillatory motion set up by a source of vibration, the pump being remote from the vibration mechanism but substantially within the oscillatory influence of the vibration.

A positive displacement pump for pumping liquids consists essentially of an elongated body which forms a first liquid inlet end and a second liquid exit end. The body further defines a cylindrical bore therethrough. A free-moving piston weight mass with a first pumping end and a second suction end is suspended within the cylindrical bore by resilient ring means positioned between the weight mass and the cylindrical bore. The piston additionally forms a passageway therethrough. The piston, when positioned approximately halfway within the cylindrical bore, defines a first liquid inlet chamber formed between the second suction end of the piston, an inner wall of the cylindrical bore formed by the body and the first inlet end. A second liquid reservoir chamber is formed between the first pumping end of the piston, the inner wall of the cylindrical bore and the second liquid exit end. The first liquid inlet chamber and the second liquid reservoir chamber vary in volume as the weight mass moves axially within the cylindrical bore.

A first spring means is positioned adjacent the second suction end of the weight mass to amplify oscillations of the weight mass axially to and fro within the cylindrical bore. A source of liquid is directed to the first liquid inlet end. A first one-way valve means adjacent the body is in liquid communication with the first liquid inlet end. A second one-way valve means is secured within the piston weight mass in liquid communication with the passageway formed by the weight mass. The second valve means is closed when the weight mass moves within the cylindrical bore toward the second liquid exit end, thereby forcing any liquid within the second liquid reservoir chamber out of the exit end. The first one-way valve means communicating with the first liquid inlet end opens substantially simultaneously as the suspended weight mass moves toward the liquid exit end, drawing liquid through the first liquid inlet end from the source of liquid substantially filling the first liquid inlet chamber. When the weight mass reverses direction at the end of its stroke, the one-way valve means in communication with the first liquid inlet end is closed and the valve means in the suspended weight mass opens, thus transferring liquid into the reservoir chamber—thereby completing one cycle of the pump.

A liquid regulating means is integral with the second liquid exit end of the elongated body. The liquid regulating means includes a means to vary the area of the second liquid reservoir chamber. The means to vary the area of the second liquid reservoir chamber is a movable exit end cap adjacent the second liquid exit end of the elongated body, the movable exit end cap being threadably engaged with the second liquid exit end of the pump body.

A vibration means is positioned substantially adjacent the elongated body. Vibratory motion, upon operation of the vibration means, is oriented substantially parallel with an axis of the body to move the suspended free-moving piston weight mass axially to and fro within the body to pump liquid therethrough from the liquid source. The pump of the present invention need only be connected or attached within the realm of effectiveness of a field of vibratory motion. In other words, the device only needs to be positioned within the effective range of the vibratory source without any direct mechanical connection between the positive displacement pump and the source of vibration. The pump will operate most efficiently in a position that orients the axis of the pump parallel with the source of oscillatory motion. However, it will also work in a realm wherein the axis of the pump is oriented between a parallel orientation and an orientation 90° to the parallel orientation as long as it is within the realm of vibratory effectiveness of the source of vibration.

An advantage then over the prior art is the non-parasitic attachment to a source of vibrational power to drive a virtually wear-proof fluid pump, the pump of the present invention being driven solely by vibrational means.

The present invention is far superior to known positive displacement vibratory pumps in that the positive displacement pump of the present invention provides a piston that freely moves within a housing without direct contact of the piston within the housing wall so that there is no wear factor involved between the piston weight mass and the housing. The piston is allowed to oscillate within the housing while suspended between a pair of resilient rings. Hence, the vibration actuatable pump is virtually indestructible. The piston can never "hang up" on the cylinder walls, rendering the pump inoperative. The pump will operate virtually indefinitely based on resiliency of the pair of resilient rings that suspend the piston within the interior wall surface of the positive displacement pump.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
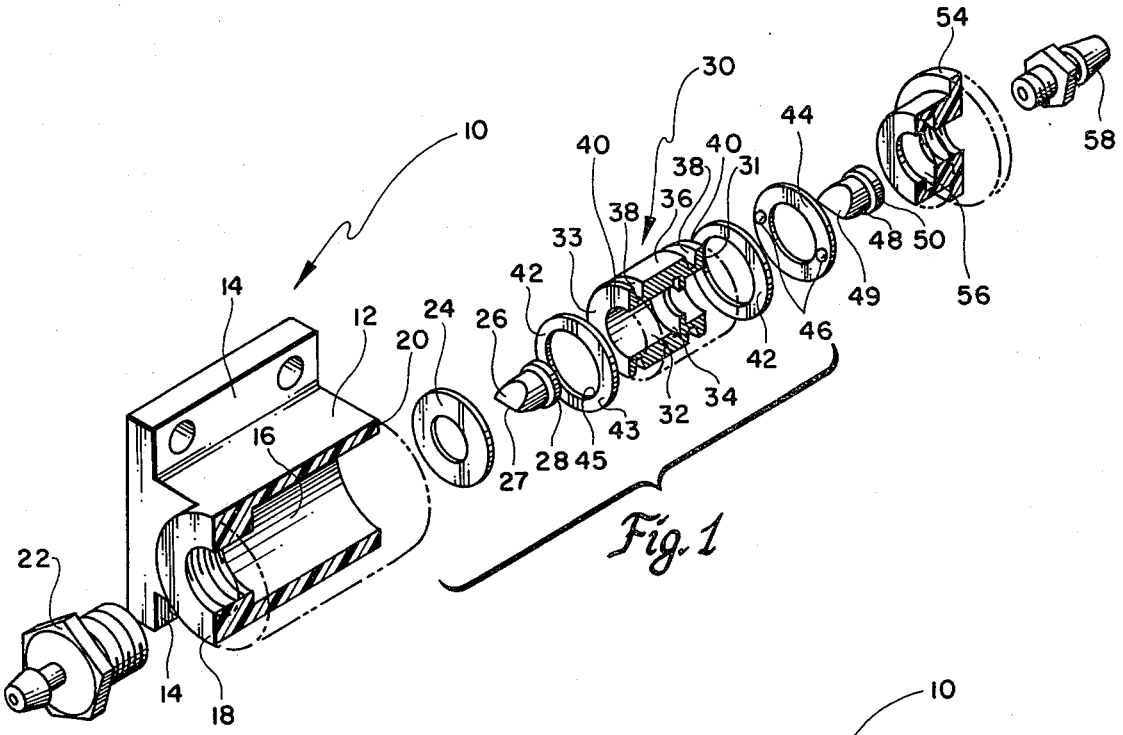
FIG. 1 is an exploded perspective view of the preferred embodiment of the present invention illustrating the various components within the positive displacement pump.

FIG. 1 is an exploded perspective view of the positive displacement pump generally designated as 10. The pump consists of pump body 12 having a pair of mounting brackets 14 integral with the body. The pump body defines an inner bore 16 and terminates at a pump exit end 18 at one end and a pump inlet end 20 at an opposite end. A fuel-regulating nipple end 22 is threadably engaged with end 18 of body 12. Within the bore 16 is a buffer ring 24 which is positioned adjacent the fluid exit nipple 22 and the piston weight mass. A piston weight mass, generally designated as 30, is suspended within the bore 16 by a pair of resilient rubberlike rings 42. An inner diameter 45 of ring 42 nests within a V-groove 38 radially cut into the piston mass 30. One groove is near end 33, the other groove being near end 31 of the piston 30. The inner diameter 45 of rings 42 snuggly nests within the base of the groove 38 while the peripheral edge 43 of rings 42 contact the inner bore 16 of body 12. The outer diameter of the piston weight mass 30 is of course less than the diameter of the bore 16 so that wall 36 of piston 30 will not contact bore 16 when positioned concentrically with the bore. The weight then is suspended between the bore 16 of body 12 by the pair of resilient rings 42 retained within groove 38 of piston 30. The grooves 38, radially cut into the piston 30, have truncated V-groove walls 40 to allow the resilient ring to flex within the groove 38 as the weight mass oscillates to and fro within bore 16 of body 12. The V-shaped walls 40 allow the resilient rubberlike rings 42 to flex within the wide end of the V-groove.

A flexible, rubberlike valve 26, having a shoulder portion 28, is retained within bore 32 of piston 30 by inserting shoulder 28 within valve retention groove 34 milled into the piston 30. The valve defines a slit portion 27 which allows fluid to pass through the valve when the opening 27 is forced open by the liquid by movement of the piston to and fro within bore 16. An inlet end cap 54 defines or retains fuel inlet nipple 58, threadably engaged with the end of the end cap 54. The end cap 54 defines an opening which retains a second flexible fluid inlet valve 48, substantially identical to valve 26, having a shoulder portion 50 at one end and a slit valve opening 49 at an opposite end. Valve 50 is retained within end 54 by a groove 56 cut into the end cap 54. A rubber silicon bumper ring 44 is disposed between end cap 54 and end 31 of piston 30. At least a pair of protruding bumpers 46 are formed in the rubber silicon ring 44. The bumpers 46 serve to cause the piston 30 to rebound when the end 31 of the piston, moving toward the inlet side of the oscillating positive displacement pump, strikes the bumpers 46. The piston movement is arrested when its inertia momentum is interrupted by the bumper spring means 44. The valves may be fabricated from silicon rubber.

Figure 2:
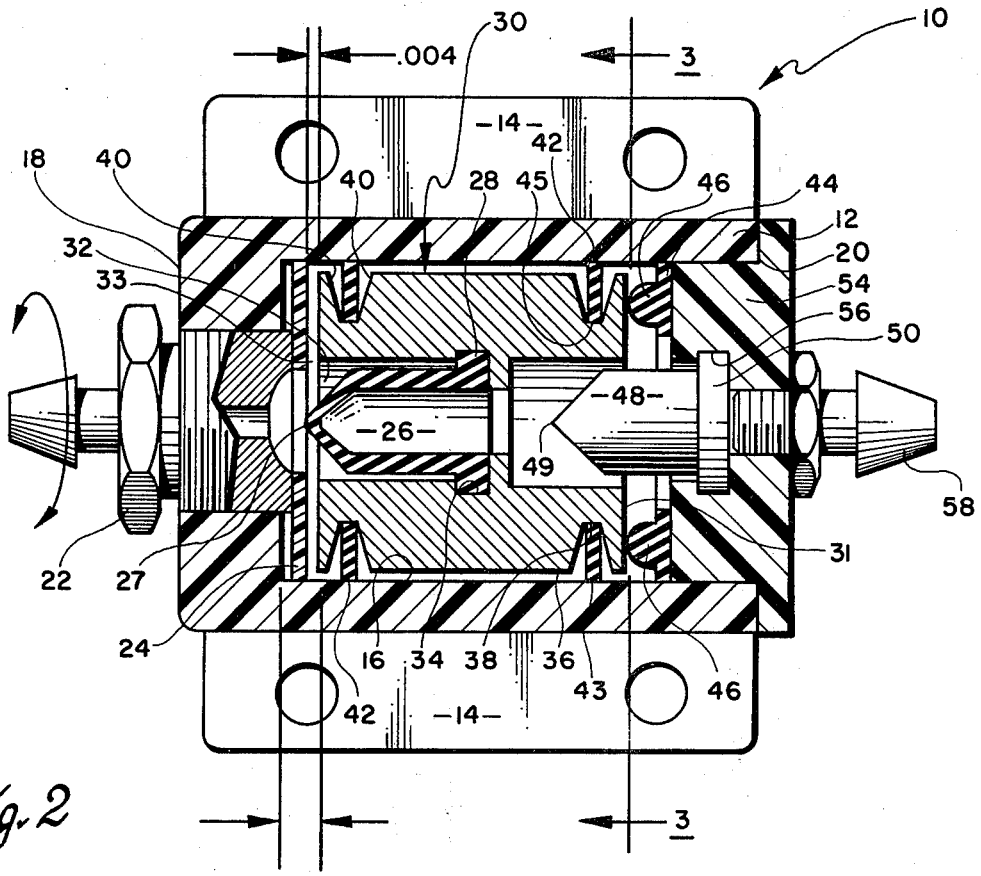
FIG. 2 is a cross section of the preferred embodiment of the present invention illustrating the positive displacement pump and the relationship of the various components within the pump.

Referring now to FIG. 2, the cross section illustrates the assembly of the positive displacement pump generally designated as 10. As can be seen, the concentric piston weight mass 30 is suspended within bore 16 of pump housing 12 by the pair of resilient silicon rings 42 retained within groove 38 of piston 30. The rings, of course, may be fabricated of other rubberlike flexible material. The outer peripheral wall 36 of piston 30 therefore cannot contact the inner bore 16 of body 12. The resilient rubber rings radially disposed within grooves 38 of piston 30 suspend the weight mass within the bore 16 without physical contact of the wall of the piston with the bore of the housing 12. The V-shaped grooves 38 (wall 40), cut into the mass weight 30, allow the piston to move relative to the body bore 16 of body 12 within the confines of the V-grooves defined by walls 40 of slot or radial grooves 38.

In operation, fluid enters nipple 58, threadably engaged with end cap 54, the end cap being retained within end 20 of body 12. The end cap 54 defines an inner valve retention groove 56 to secure the valve shoulder 50 of valve 48 within the groove. At the exit end of the valve 48 is a slit opening 49. The opening allows fluid entering nipple 58 to escape through the slit 49 into a chamber formed between end 31 of the piston weight mass 30 and the end cap 54. As the piston weight mass 30 moves toward the exit end or end 18 of the body 12, fluid is drawn in through valve 48 into the fluid inlet chamber as the piston mass moves away from fluid inlet end 20. The valve 26, retained within groove 34 of piston 30, remains closed due to the action of the liquid pressure on the outside surface of the valve, forcing slit 27 of valve 26 to remain closed while liquid is drawn through valve 48 as the piston mass is moving toward end 18 of body 12. The end 33 of piston 30 strikes buffer ring 24 at the end of its fluid intake stroke. The oscillatory motion causes the piston weight mass 30 to move subsequently towards fluid inlet end 20, forcing valve 48 closed, opening valve 26 and causing liquid trapped in a chamber formed between end 33 of piston 30 and the exit end 18 of the body 12 to escape through fluid outlet nipple 22. Fluid then is forced through opening 27 of valve 26, out through nipple 22, as the piston is driven away from end 18 towards end 20. The end 31 of piston 30 strikes the silicon ring spring member 44, compressing protrusions 46 integral with the rubber ring 44, thus causing the piston 30 to rebound towards fluid exit end 18, thereby beginning a new cycle of the positive displacement pump.

The positive displacement fluid pump may be regulated by restricting the oscillatory motion of the piston weight mass 30 within bore 16 of housing 12. By simply screwing in or out the exit nipple 22, the axial travel of the piston weight mass 30, suspended between the resilient rings 42, is restricted. The volume of liquid pumped then is controlled by varying the area in which the piston may travel within bore 16 of body 12. Screwing the threaded nipple 22 out of end 18 enlarges the area the piston may travel, thus increasing the flow rate of the fluid or liquid through the positive displacement pump. Screwing in nipple 22 into end 18 of body 12 lessens or reduces the area within bore 16, thus reducing the flow rate of fluid through the pump.

Figure 3:
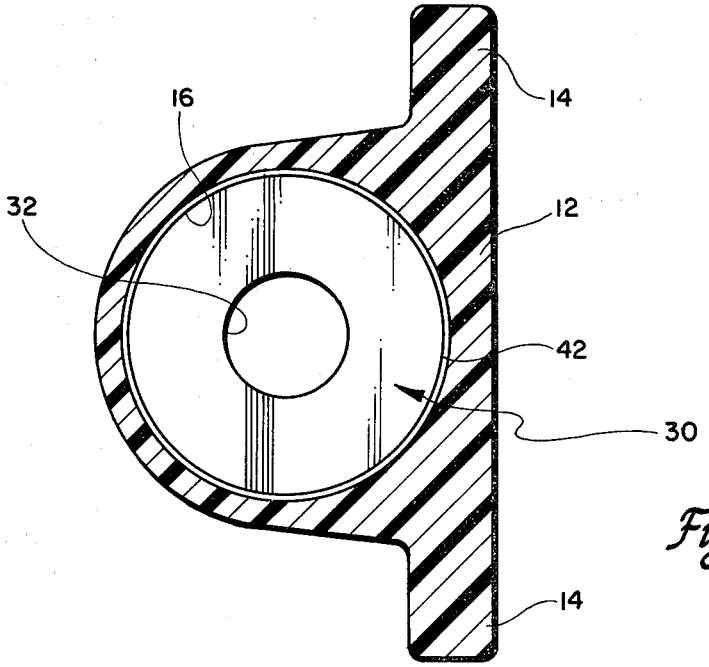
FIG. 3 is a view taken through 3—3 of FIG. 2 illustrating a section through the pump and the relationship of the piston weight mass within the housing illustrating that the exterior surface of the weight mass does not come in contact with the interior wall of the housing.

FIG. 3 clearly illustrates the piston weight mass 30 as it is suspended within bore 16 of housing 12. It can readily be realized then that the walls 36 of piston weight mass 30 never contact bore 16 of housing 12.

Figure 4:
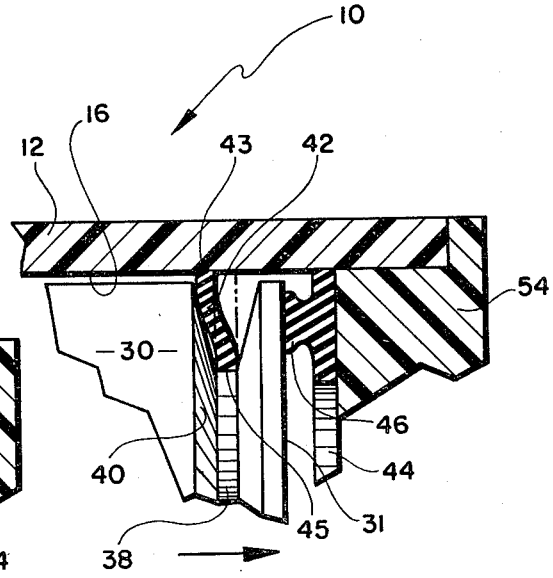
FIG. 4 is a partial cross sectional enlargement of the piston weight mass that is positioned toward the inlet side of the positive displacement pump illustrating the flexible ring which suspends one end of the piston from the displacement pump wall.

Referring now to FIG. 4, the partial cross section illustrates an enlargement of a portion of the piston and how it coacts with the resilient spring member 44. End 31 of piston 30 strikes the protrusion 46 of the silicon spring member 44, thus compressing the bumps, causing the piston 30 to arrest its axial movement towards the inlet end cap 54 and rebound the piston in the opposite direction towards exit end 18 of housing 12 (see FIG. 2). The resilient rubber rings 42 thus deflect within V-groove 38, the V being formed by walls 40 of the groove. The peripheral edge 43 of rings 42 contacts cylindrical bore 16 and remains relatively fixed axially along bore 16 while the inner diameter 45 of the ring 42 is secured within groove 38, thus the piston oscillates within bore 16 through the flexibility of the rubber ring 42.

Figure 5:
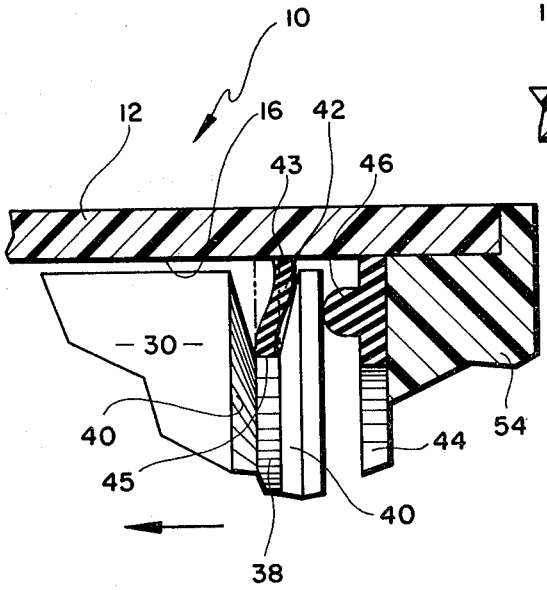
FIG. 5 is a view illustrating a partial cross sectional view wherein the positive displacement piston mass is in a position away from the inlet end of the positive displacement pump.

FIG. 5 is a view substantially identical to FIG. 4 illustrating the piston 30 at it travels closest to end 18 of body 12. The ring 42, of course, is flexed in the opposite direction, the inner diameter 45 being securely retained within groove 38 while the peripheral edge 43 of the ring is axially fixed within bore 16 of body 12. End 33 of piston weight mass 30 strikes buffer ring 24, positioned between the end of nipple 22 and the end 33 of piston weight mass 30. The buffer 24 is not necessary to the operation of the pump 10. In this example, the plastic or nylon buffer prevents the metal weight mass 30 from impacting the inner end of metal nipple 22. Reciprocating action of piston weight mass 30 works in cooperation with the fluid inlet valve 48 and the valve 26 retained within the piston 30 to draw fluid through inlet end 54 and to expel fluid through exit end 18 through nipple 22 as the piston travels toward the fluid inlet end 54. The cycle repeats itself, the oscillatory motion being based on the frequency of oscillation of the vibrating source driving the positive displacement pump 10.

Where the positive displacement pump is relatively small, the pump may be fabricated from a variety of materials. For example, the body 12 may be fabricated from a plastic material such as nylon; the nipple regulator 22 of aluminum; the piston weight mass of a heavy metal such as brass or steel; the buffer ring 24 of nylon and the rings 42, valves 26–48 and spring 44 of a rubberlike material such as silicon. Obviously, other resilient material such as rubber or latex may be substituted.

The valves 26 and 48, being fabricated from the rubberlike material, can respond to fluid pressure through the flexible slit openings 27–49, dependent upon the direction of motion of the piston weight mass 30 within bore 16.

Where the pump body is, for example, a little over an inch long, defining a bore approximately a half-inch in diameter, the piston weight mass 30 need only move between four-thousandths of an inch and, for example, twelve-thousandths of an inch within the bore 16. The travel of the oscillating piston weight mass is controlled by the axial position of fluid exit nipple 22, threadably engaged with end 18 of housing 12. Screwing in the nipple 22 reduces the area between end 33 of the weight mass 30 and the nipple 22, thus restricting the oscillation of the piston within bore 16. As stated before, the plastic buffer 24 prevents damage to the end 33 of the metal piston 30 since it cannot strike the metal end of the nipple body 22.

In an operating mode, for example, where the vibratory source is a miniature two-cycle aircraft engine, the positive displacement pump 10 is securely mounted within the realm of influence of the vibration or torque of the operating engine. The pump serves to supply liquid fuel to a carburetor of the two-cycle engine (not shown). To regulate the pump of the present invention, the nipple 22 is screwed out of body 12 to allow maximum travel of the piston weight mass 30 within bore 16 (thus maximum liquid fuel through the pump). The engine is initially operated at a high RPM with the needle valve of the two-cycle engine screwed out of the carburetor to cause the two-cycle engine to run extremely rich or in a four-cycle operating mode. While the engine is running in this rich or four-cycle mode, the nipple 22 is slowly screwed into the body 12 of the pump 10 until the engine begins to run in a two-cycle or high RPM mode. The pump, however, is set with the engine still slightly rich. The adjustment of the positive displacement pump is now set. The engine is allowed to run slightly rich after adjustment of the pump to enable final tuning or adjustment of the engine in the high RPM range by subsequently screwing in the needle valve of the carburetor until the engine reaches maximum RPM. This is all that is necessary to regulate the positive displacement pump for operation of a two-cycle engine. When the engine is throttled down during operation, the regulated pump then will not supply an excessive amount of fuel to the carburetor in the low RPM operating range.

Regulation of the quantity of fuel per stroke of the piston weight mass within the bore 16 of body 12 is controlled by limiting the travel of the piston within the bore through manipulation of the threaded nipple 22.

The positive displacement pump of the present invention could be used to pump any liquid or fluid.

For example, in the medical field of technology, the pump could be used to transfer intravenous fluids into a patient with precise control of the rate at which the fluid flows into the patient. Or, the pump could be used to pump plasma or whole blood into an individual.

In addition, it would be obvious to fabricate the pump of any size and from a variety of materials. For example, the piston weight mass could be molded from plastic material, encapsulating a weighted mass within the piston structure.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A pump for pumping fluids comprising:

an elongated body forming a first fluid inlet end and a second fluid exit end, said body further defining a cylindrical bore therethrough, a free-moving piston weight mass having a first pumping end and a second suction end is suspended within said cylindrical bore by resilient means positioned between the weight mass and the cylindrical bore, said piston forming a passageway therethrough, said resilient means is two substantially radially disposed resilient rings suspending said piston in said cylindrical bore, a first resilient ring being retained in a circumferential groove formed in said piston and positioned near said first pumping end of said piston weight mass, a second resilient ring being retained in a groove formed in said piston and positioned near said second suction end of said piston, the outer peripheral edge of the resilient rings do not move axially relative to the piston weight means suspended in the cylindrical bore by the rings, said piston weight mass, when positioned approximately halfway within said cylindrical bore defines a first fluid inlet chamber formed between said second suction end of said piston, an inner wall of said cylindrical bore formed by said body and said first inlet end, a second fluid reservoir chamber being formed between said first pumping end of said piston, said inner wall of said cylindrical bore and said second fluid exit end, said first fluid inlet chamber and said second fluid reservoir chamber varying in volume as the weight mass moves axially within said cylindrical bore, a source of fluid directed to said first fluid inlet end, a first one-way valve means secured to said body in fluid communication with said first fluid inlet end, a second one-way valve means secured to said piston weight mass in fluid communication with said passageway formed by said piston weight mass, said second valve means is closed when said piston moves within said cylindrical bore toward said second fluid exit end thereby forcing any fluid within said second fluid reservoir chamber out of said exit end, said first one-way valve means communicating with said first fluid inlet end opens substantially simultaneously as said piston moves toward said fluid exit end drawing fluid through said first fluid inlet end from said source of fluid substantially filling said first fluid inlet chamber, as said piston weight mass reverses direction at the end of its stroke, said one-way valve means in communication with said first fluid inlet end being closed and the valve means in communication with said piston weight mass is opened thus transferring fluid into said reservoir chamber thereby completing one cycle of said pump, and vibration means positioned substantially adjacent said elongated body, oscillatory motion, upon operation of said vibration means, serves to move said suspended weight mass axially to and fro within said body to pump fluid therethrough from said fluid source.

2. The invention as set forth in claim 1 further including fluid regulating means integral with said second fluid exit end of said elongated body.

3. The invention as set forth in claim 2 wherein said fluid regulating means includes a means to vary the area of the second fluid reservoir chamber.

4. The invention as set forth in claim 3 wherein said means to vary the area of the second reservoir chamber is a movable fluid exit end cap adjacent the second fluid exit end, said fluid exit end cap being threadably engaged with said elongated body.

5. The invention as set forth in claim 1 wherein said elongated body is fabricated from nylon material.

* * * * *